US006532916B2

(12) United States Patent
Kerrebrock

(10) Patent No.: US 6,532,916 B2
(45) Date of Patent: Mar. 18, 2003

(54) OPPOSED PISTON LINEARLY OSCILLATING POWER UNIT

(75) Inventor: Jack L. Kerrebrock, 108 Tower Rd., Lincoln, MA (US) 01773

(73) Assignee: Jack L. Kerrebrock, Lincoln, MA (US)

( * ) Notice: Subject to any disclaimer, the term of this patent is extended or adjusted under 35 U.S.C. 154(b) by 0 days.

(21) Appl. No.: 09/820,125

(22) Filed: Mar. 28, 2001

(65) Prior Publication Data

US 2002/0139323 A1 Oct. 3, 2002

(51) Int. Cl.[7] ..... F02B 71/00
(52) U.S. Cl. ..... 123/46 E
(58) Field of Search ..... 123/46 E, 55.2, 123/55.5, 55.7

(56) References Cited

U.S. PATENT DOCUMENTS

| | | | | |
|---|---|---|---|---|
| 4,128,083 A | * | 12/1978 | Bock | 123/46 R |
| 4,381,903 A | | 5/1983 | Atkins | |
| 4,532,431 A | * | 7/1985 | Iliev et al. | 123/46 E |
| 4,907,548 A | * | 3/1990 | Lee | 123/55.7 |
| 5,002,020 A | * | 3/1991 | Kos | 123/46 E |
| 5,029,559 A | | 7/1991 | Lively, Sr. | |
| 5,528,946 A | * | 6/1996 | Yadegar | 123/55.7 |
| 5,638,778 A | | 6/1997 | James | |
| 5,778,834 A | | 7/1998 | Piccinini | |
| 5,809,864 A | | 9/1998 | Ashton | |
| 5,992,356 A | | 11/1999 | Howell-Smith | |
| 6,189,493 B1 | | 2/2001 | Gray, Jr. | |
| 6,349,683 B1 | * | 2/2002 | Annen et al. | 123/46 E |

OTHER PUBLICATIONS

Greenman, M.D., "Design and Construction of a Miniature Internal Combustion Engine", Master of Science Thesis, Massachusetts Institute of Technology, Jun. 1996.

* cited by examiner

*Primary Examiner*—Marguerite McMahon
(74) *Attorney, Agent, or Firm*—Thomas J. Engellenner; David D. Nielson; Nutter McClennen & Fish LLP

(57) ABSTRACT

A piston/cylinder internal combustion unit has opposed pistons connected to a common rod and driven in an oscillatory and reciprocating movement. The pistons operate out of phase with each other, such that the power stroke of one drives the compression stroke of the other, and a spring acts on the rod storing energy or exerting a restorative force as the rod is displaced with piston movement. Preferably, the moving rod carries a coil assembly near a stationary magnet (or a magnet near a stationary coil assembly) to produce electricity at the oscillatory frequency. The engine may employ a mechanical spring, an electromagnetic or a magnetic spring, or combinations thereof to stabilize or establish oscillation of the piston and rod assembly. The coil itself may fill this function and act to exert restoring force by coupling to an external control system that applies a control a signal to the coil in accordance with piston position to create an electromagnetic restoring force of appropriate level. The piston rod may couple to a first coil that acts as a spring, and a second coil that functions as an alternator to generate power. By driving the pistons in opposite phase, or by providing a magnetic/electromagnetic spring mechanism, a higher constant k is achieved, raising the frequency of oscillation and increasing power output of the engine.

4 Claims, 2 Drawing Sheets

OPPOSED PISTON LINEARLY OSCILLATING POWER UNIT

CROSS REFERENCE TO RELATED APPLICATION

N/A

STATEMENT REGARDING FEDERALLY SPONSORED RESEARCH

N/A

BACKGROUND OF THE INVENTION

The present invention relates to internal combustion engines and to fueled motive power units which may, for example, be applied to generate electricity or perform other mechanical work.

Internal combustion engines have been around for over a century and engineers have evolved a number of constructions that optimize one or more of the factors affecting their operation to enhance performance in the various particular functions in which they are employed. The present invention relates generally to piston engines.

In general, a number of factors must be considered in designing a piston engine. Such an engine operates generally by compressing a fuel mixture, igniting the mixture and extracting mechanical energy from the expanding combustion gases by driving the piston with the combustion. The piston, in turn, is mechanically coupled to perform useful work as it moves, e.g., by turning drive wheels of a vehicle, turning the rotor of a generator, moving the tool or work piece holder of an industrial machine, or other such action. The complexity of construction of an internal combustion engine may cover a great range, with different mechanical linkages to effect movement of the pistons, and in four stroke embodiments to coordinate piston travel with movement of valves and other components. Often the efficiency of an engine varies with engine speed, and basic design choices such as the stroke, compression ratio, and the like affect the overall efficiency that may be achieved. These factors may vary both for practical reasons (owing to limitations of carburetion processes, airflow, gearing efficiencies and the like) and for intrinsic or theoretical reasons (owing to thermodynamic limitations related to supply and combustion pressures and temperatures, cycle time and the like).

One construction that has been proposed as a small motor for delivering electric power addresses a number of these factors by combining a piston/cylinder combustion unit with an oscillatory spring mass alternator mechanism. This construction, now conventionally termed midget internal combustion engine (or MICE), employs a piston/cylinder mechanism operated as a conventional two-stroke engine, with the piston carried on a central rod that linearly reciprocates as the piston moves, operating against the force of a spring so that the engine runs in an oscillatory mode without requiring rotating shafts or journals. In one useful integration, the piston rod carries a coil assembly located so that, as the engine runs, the coil is moved back and forth within the field of a magnet secured to the housing, thus generating electrical power.

Such a construction is mechanically simple, and offers the possibility of running at a constant speed range so that the fuel mixture may be accurately adjusted for power or efficiency. The construction may also be scaled quite small to produce portable or emergency drive units for applications such as electrical power generation.

However, in requiring that a spring store and return energy, one faces certain limitations due to the presence of high stresses that become higher with displacement, and may cause a short fatigue life for the spring, thus leading to engine break down; or that limit the achievable stroke or the level of obtainable compression, hence limiting the thermal efficiency of the engine.

Accordingly, it would be desirable to provide an improved engine construction.

It would also be desirable to provide a linear combustion engine construction in which components are subjected to lower stress levels.

It would also be desirable to provide a dependable small engine.

SUMMARY OF THE INVENTION

One or more of the foregoing desirable ends are achieved in accordance with the present invention by a piston/cylinder combustion unit having opposed rigidly connected pistons driven in an oscillatory fashion. The pistons are connected to a common shaft and operate out of phase with each other, such that the power stroke of one corresponds to the compression stroke of the other. A mechanical spring acts on the common shaft, storing energy or exerting a restorative force as the shaft is displaced with piston movement. Preferably, the moving shaft carries a coil assembly near a stationary magnet, forming a reciprocating alternator to produce electricity at the oscillatory frequency. In one embodiment, rather than a mechanical spring, the engine employs an electromagnetic spring. For this purpose, the coil itself may act to exert restoring forces. It may, for example, be coupled to an external control system that applies a control a signal to the coil in accordance with piston position and/or phase or direction of travel to create an electromagnetic restoring force of appropriate magnitude. In another or further embodiment, the shaft may carry a first coil that acts as a spring, and a second coil that functions as an alternator to generate power. Different arrangements of magnets, force coils and power coils are possible.

BRIEF DESCRIPTION OF THE DRAWINGS

These and other features of the invention will be understood from the discussion below taken together with Figures showing illustrative embodiments, wherein.

DETAILED DESCRIPTION OF THE INVENTION

Figure 1:
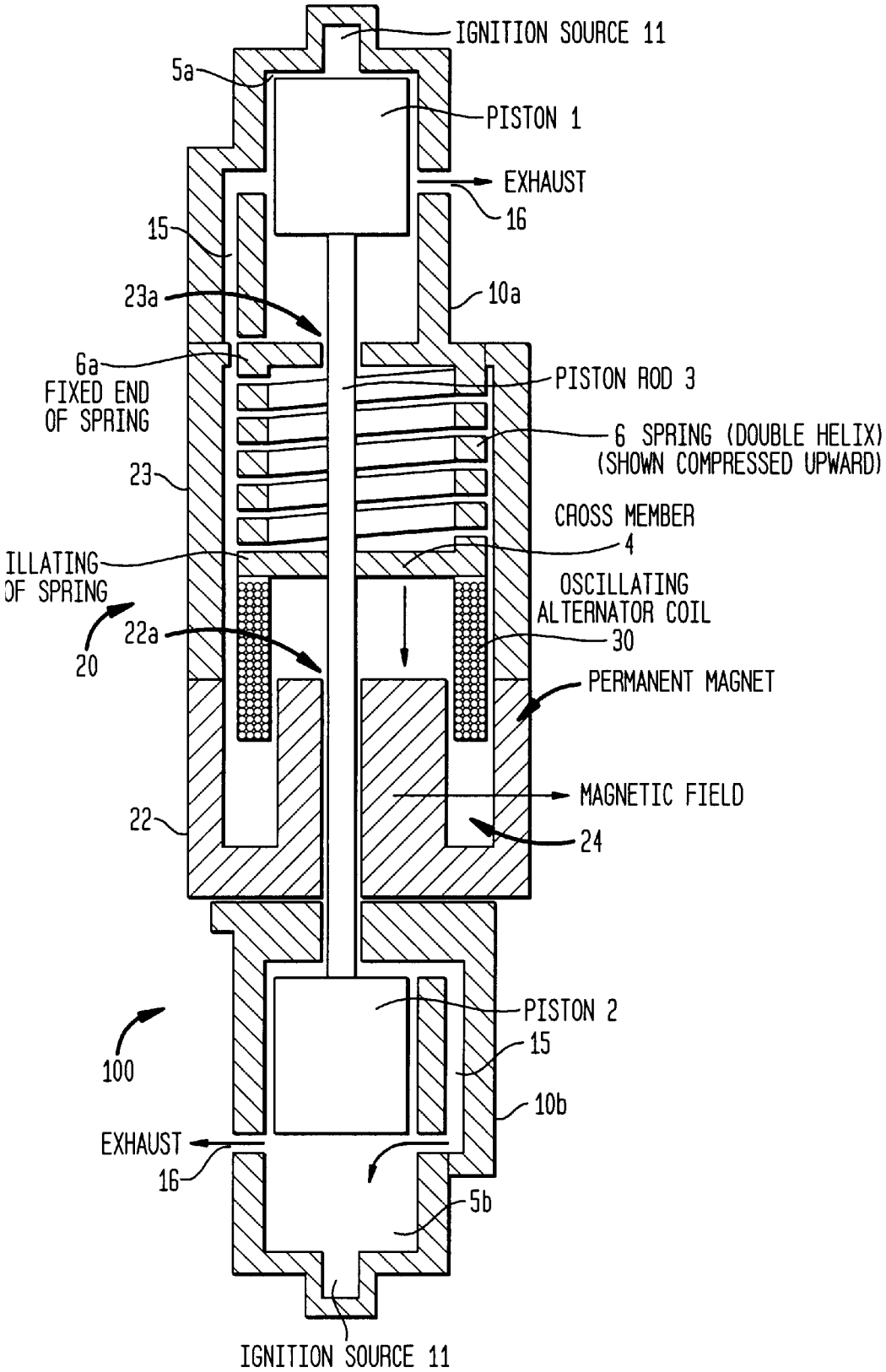
FIG. 1 illustrates one embodiment of an internal combustion engine in accordance with the present invention.

FIG. 1 illustrates one embodiment of an internal combustion engine 100 in accordance with the present invention. Engine 100 has opposed pistons 1, 2 interconnected by a piston rod 3 for reciprocating movement of the pistons in respective combustion chambers 5*a*, 5*b*. The combustion chambers are formed by respective housing assemblies 10*a*, 10*b* which each include an end or upper region with an ignition source 11, such as a spark, glow or catalytic initiator source, and include a bore in which the piston moves.

In the illustrated embodiment, the engine 100 is a two-cycle engine. The ends of the housing forming the combustion chambers each further include a fuel inlet port or passage 15, and an exhaust port 16 arranged close to the bottom of piston travel. The illustration is schematic, and it will be understood that an exhaust manifold or further conduit-defining housing structure may connect at the exhaust port 16, and likewise, an inlet manifold may connect to the housing to supply the passage 15. The various walls or passages of the housing may themselves constitute an intake manifold, and one or more carburetors or various forms of injector or pressurized fuel supply systems may couple to or communicate with the inlet passage 15.

As shown in FIG. 1, the housing portions 10*a*, 10*b* are mounted in line at opposite ends of a central engine body 20. The central body 20 in this embodiment includes a magnetic stator portion 22 and a structural portion 23 assembled together to form an elongated linear support for the piston rod 3. As shown the rod 3 passes through a linear bushing 23*a* at one end of the central housing and through a coaxially aligned bushing 22*a* at the other end of the housing, so that movement of the pistons is constrained to be purely linear. The housing may take various forms. It may be constructed using tubular portions to which separate end plates having the through passages 23*a*, 22*a* are attached, or it may be implemented with other shaped castings, turnings, cup-like or other semi-open housing portions and the like to form the overall operative housing of the illustrated construction.

One embodiment may advantageously employ cylindrical or substantially cylindrical pistons, and have a central body portion that has a hollow cylindrical interior substantially coaxial with the end bushings 23*a*, 22*a*. However, in other embodiments, the central body 20 may have other geometries, consistent with the shapes of the structures contained therein, as described further below. Similarly, the central housing portion need not be formed of two separate end assemblies as shown, but may include constructions built up of diverse spacers, shell and plates, or constructions wherein the magnet portion is inserted within or bolted down to another housing portion or sub-assembly thereof.

Continuing with description of FIG. 1, the piston rod 3 has a cross member 4 attached in a central region, and the cross member 4 supports an electrical coil or winding 30 having a height dimension extending parallel to the axis of the rod 3. The coil is positioned such that as the pistons 1, 2 move back and forth, the reciprocating motion of piston rod 3 carries the coil 30 back and forth in a magnetic gap 24 formed by inner and outer portions of a magnet in the end housing structure 22. The cross member 4 also connects to a spring 6 which, as shown, has one end fixed at 6*a* against the housing 23, so that as the pistons move back and forth, the cross member 4 changes the length of the spring. and the spring stores energy or returns it to the piston rod in accordance with its degree of displacement. The rod, cross member, coil and pistons thus form an oscillating mass, which may be a resonant system having a resonant frequency determined by appropriate selection of the total mass and the spring constant. These may be tailored to achieve a particular operating frequency.

In addition to energy storage within the spring, the arrangement of pistons 1, 2 as shown results in them firing during alternating cycles, so that when piston 1 fires, piston 2 compresses. In this manner the compression of fuel in the chambers 5*b*, 5*a* during each cycle acts similarly to a compression spring to store energy from the combustion stroke of the opposed piston and exert a counter- or restoring force. This provides an effective additional spring constant k, and may allow one to obtain a higher frequency of oscillation than would be obtained using a mechanical spring alone. The illustrated mechanical spring 6 may have a double helix construction, e.g., may comprise a clockwise and a counterclockwise helical spring, one seated just within the other, so that the rotational components introduced by spring compression and extension are canceled and the piston rod is subjected to purely axial forces.

The embodiment illustrated in FIG. 1 applies the motive power of the moving pistons and rod to move a coil 30 back and forth in the gap of a magnetic field created between opposing poles of the magnet stator structure of the portion 22, thus constituting a reciprocating alternator to derive electrical power from the combustion engine.

As illustrated, the structure includes a radially inner and a radially outer pole piece. The magnet assembly may conveniently be formed of an outer annular (or cylindrical) magnet member and an inner annular (cylindrical) member (not numbered), positioned to define a flux gap in the space therebetween in which coil 30 is moved. These magnets may, for example, each be radially poled and of opposite polarity to each other. The magnets need not occupy the full volume of end 22, but may instead comprise relatively thin liners or plates fastened to that end piece to define a flux gap in the illustrated region around the coil 30. Current induced in the coil 30 passes through suitable cabling or contacts (not shown) to connectors on the outside of the unit, and this current may be rectified and smoothed by diodes and circuitry of conventional type to provide conditioned DC power.

Figure 2:
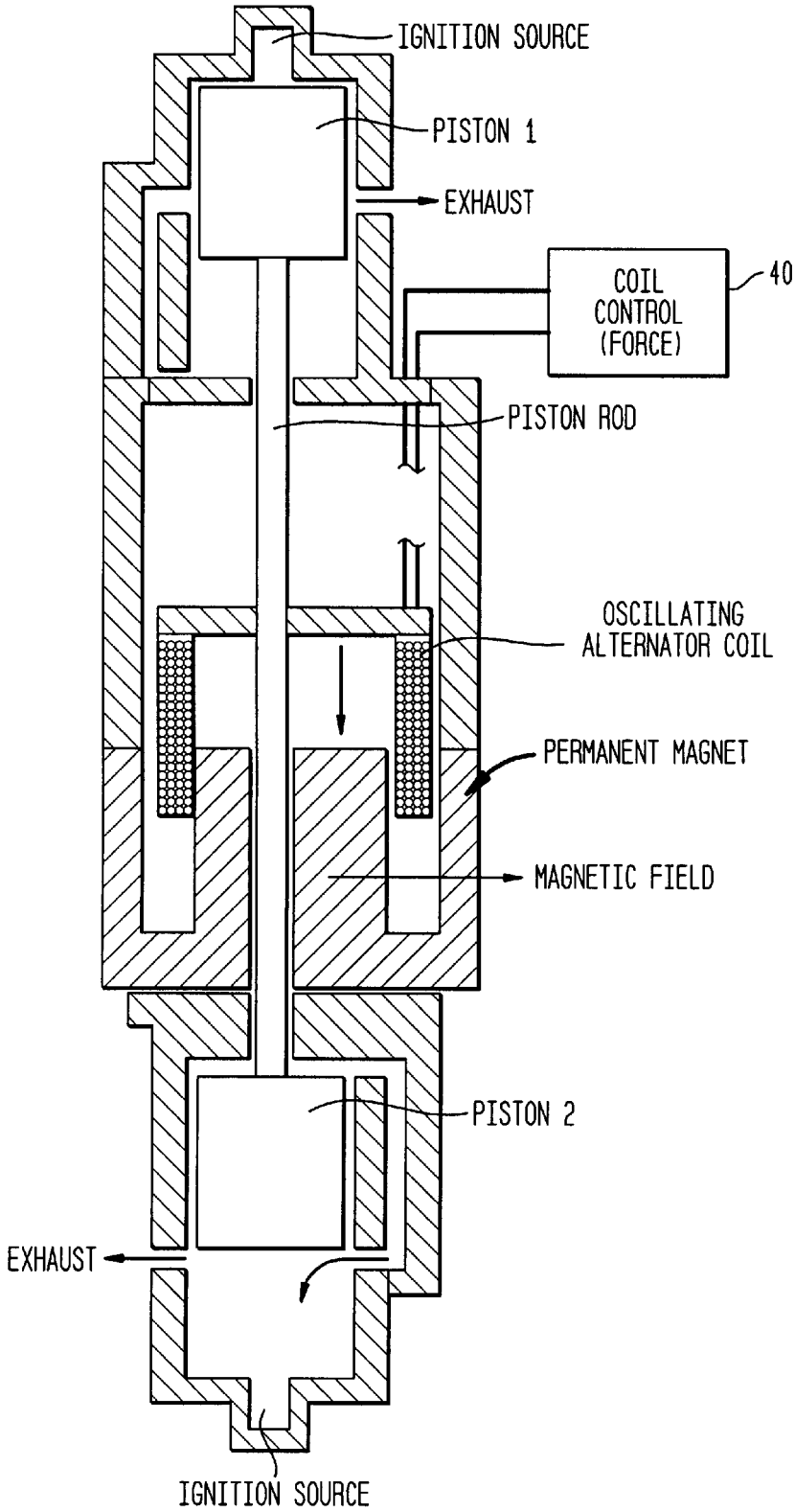
FIG. 2 illustrates another embodiment of an engine according to the invention.

In accordance with another embodiment of the invention, the electrical coil 30 itself may be used instead of the helical spring 6 to provide restoring forces for the moving rod assembly. In this case, the coil is connected to an external coil force control unit 40 as shown in FIG. 2. Control unit 40 may, for example, apply a current to the coil effective to introduce an electromagnetic field component that exerts an axially-directed restoring force against the cross member 4 on which the coil is carried. In this case, one or more suitable sensors, such as Hall effect sensors arranged near the rod or pistons are preferably provided to enable the coil control unit 40 to coordinate the phase (or direction) and the magnitude of its driving signals with the actual displacement and/or speed of the rod 3 at each instant in time.

One such arrangement is shown in FIG. 2, but, the invention may take yet other forms. For example, rather than employing the coil 30 to create restoring forces, another embodiment may retain the coil 30 as an alternator coil (as shown in FIG. 1) and provide an additional electrical coil winding and appropriate magnet structure (e.g., in the upper portion of the central body 23) for creating an electromagnetic restoring force as described above. In this case the alternator coil 30 may be used to provide phase synchronization signals that are used by the control unit 40 (FIG. 2) to set the electromagnetic spring force driving current. Furthermore, the windings of a coil may be oriented, in relation to the magnets, to optimize axial force generation. In addition, other spring arrangements, such as sets of oppositely-poled permanent magnets, may be used to define other axial-force spring units, such as a high-force but small effective distance pair of magnets positioned to define a non-mechanical end-of-travel stop for the piston rod 3. The actual selection of a combination of mechanical, magnetic and electromagnetic spring mechanisms will in general depend of the compression, mass, desired frequency of operation and other specifics of the intended engine.

Thus, by providing opposed pistons driving a linear oscillating system, applicant is able to provide a compact power source having very simple construction and mechanically hardy subcomponents.

The invention being thus disclosed and illustrative embodiments described, variations and modifications will occur to those skilled in the art, and all such variations and modifications are considered to be within the scope and spirit of the invention illustratively described herein, and defined by the claims appended hereto and equivalents thereof.

What is claimed is:

1. A power system comprising an internal combustion engine having dual opposed pistons interconnected by a rigid connecting rod and coupled to at least one spring assembly having a double helix configuration so as to form a linear oscillating mass system, said rod carrying a coil positioned to reciprocate in a magnetic gap and generate electrical power.

2. An internal combustion engine comprising first and second pistons, a connecting rod interconnecting the first and second pistons, and at least one spring assembly having a double helix configuration coupled to the connecting rod, the spring and opposed pistons being opposed and operating alternately providing restoring force for oscillating movement of the connecting rod along a linear axis, the rod carrying a coil for reciprocating travel in a magnetic field such that energy is efficiently extracted from the moving assembly as the pistons are driven by internal combustion.

3. An internal combustion engine having a first piston and a second piston, the first and second pistons being attached to opposite ends of a single piston rod, and a plural spring assembly coupled to the rod so as to cancel rotational force components and to maintain an oscillating movement of the mass comprising said pistons and said single piston rod as the pistons are driven by forces of combustion.

4. The internal combustion engine of claim 3, further comprising a coil assembly and a magnet assembly at least one of said coil and said magnet assembly being carried by the piston rod to provide relative reciprocating movement between the coil assembly and the magnet assembly to thereby generate electrical energy.

* * * * *